US008070499B2

(12) United States Patent
Guan et al.

(10) Patent No.: US 8,070,499 B2
(45) Date of Patent: Dec. 6, 2011

(54) CARD EDGE CONNECTOR WITH AN IMPROVED RETAINER

(75) Inventors: Hai-Fei Guan, Kunshan (CN); Wen-Jun Tang, Kunshan (CN); Xue-Wu Bu, Kunshan (CN)

(73) Assignee: Hon Hai Precision Ind, Co., Ltd., New Taipei (TW)

( * ) Notice: Subject to any disclaimer, the term of this patent is extended or adjusted under 35 U.S.C. 154(b) by 0 days.

(21) Appl. No.: 12/882,384

(22) Filed: Sep. 15, 2010

(65) Prior Publication Data

US 2011/0065297 A1 Mar. 17, 2011

(30) Foreign Application Priority Data

Sep. 15, 2009 (CN) ..... 2009 2 0310362 U

(51) Int. Cl.
*H01R 13/62* (2006.01)

(52) U.S. Cl. ..... 439/155

(58) Field of Classification Search ..... 439/155, 439/156–160

See application file for complete search history.

(56) References Cited

U.S. PATENT DOCUMENTS 4,898,540 A * 2/1990 Saito ..... 439/153
5,207,598 A * 5/1993 Yamada et al. ..... 439/636
5,211,568 A * 5/1993 Yamada et al. ..... 439/157
5,226,833 A * 7/1993 Lwee ..... 439/326
5,443,394 A * 8/1995 Billman et al. ..... 439/157
5,445,531 A * 8/1995 Billman et al. ..... 439/160
5,470,242 A * 11/1995 Cheng et al. ..... 439/157
5,577,922 A * 11/1996 Enomoto et al. ..... 439/157
5,865,649 A * 2/1999 Yu et al. ..... 439/637
5,980,282 A * 11/1999 Cheng ..... 439/157
6,059,585 A * 5/2000 Liao et al. ..... 439/157
6,276,950 B1 * 8/2001 Yodogawa ..... 439/160
6,695,630 B1 * 2/2004 Ku ..... 439/152
6,948,957 B1 * 9/2005 Costello et al. ..... 439/157
7,517,239 B1 * 4/2009 Ju ..... 439/159
7,666,011 B2 * 2/2010 Lim et al. ..... 439/157
7,677,907 B2 * 3/2010 Guan et al. ..... 439/157
7,746,665 B2 * 6/2010 Junkins et al. ..... 361/801
7,828,566 B2 * 11/2010 Chen et al. ..... 439/157
7,887,334 B2 * 2/2011 Miki et al. ..... 439/62
2006/0003618 A1 * 1/2006 Leidy ..... 439/160
2008/0026618 A1 * 1/2008 Mon et al. ..... 439/159
2008/0220637 A1 * 9/2008 Guan et al. ..... 439/157
2008/0220642 A1 * 9/2008 Guan et al. ..... 439/325
2008/0220654 A1 * 9/2008 Guan et al. ..... 439/629
2009/0088003 A1 * 4/2009 Szczesny et al. ..... 439/62

(Continued)

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

A card edge connector for mating with an electronic card includes an elongated housing, a number of contacts and a retainer retained to the housing. The housing has a pair of side walls, a central slot between the side walls and a fitting section upwardly extending at one end thereof. The fitting section defines a first U-shaped cavity downwardly extending from a top end thereof and a mounting slot upwardly extending from a lower end thereof and located at outside of the first cavity. The first cavity communicates with the central slot along a length direction of the housing to receive the electronic card. The retainer is retained in the mounting slot and has a locking projection protruding into the first cavity to lock with the electronic card. The mounting slot does not extend through the fitting section to make the retainer hidden in the fitting section.

20 Claims, 11 Drawing Sheets

U.S. PATENT DOCUMENTS

2009/0093146 A1* 4/2009 Ju ..... 439/159
2010/0105248 A1* 4/2010 Tang et al. ..... 439/630
2011/0065297 A1* 3/2011 Guan et al. ..... 439/155
2011/0076868 A1* 3/2011 Yao et al. ..... 439/153

* cited by examiner

CARD EDGE CONNECTOR WITH AN IMPROVED RETAINER

BACKGROUND OF THE INVENTION

1. Field of the Invention

The present invention relates to card edge connectors, more particularly to card edge connectors with an improved retainer.

2. Description of Related Art

Card edge connectors are employed widely in computers to receive a memory card, graphic card, network interface et al. The card edge connector usually have an elongated housing, a plurality of contacts retained in the housing for electrically connecting a corresponding mating card, and at least a retainer at one end thereof for locking the mating card. The housing has a pair of side walls, a central slot between the side walls for receiving the mating card, and a fitting section at one end thereof. The fitting section defines a mounting slot extending therethrough along an up to down direction and a pair of limiting walls at two sides of the mounting slot. The retainer is upwardly assembled to the mounting slot and upwardly extends beyond the fitting section. The retainer has a retaining portion at a lower side thereof and a flexible arm portion upwardly extending from the retaining portion. The retaining portion is wider than the arm portion, and the mounting slot is formed with a step portion at inner side thereof to limit the retaining portion moving upwardly. The arm portion has a guiding portion upwardly and sidewardly extending beyond the fitting section at an upper side thereof for guiding the electronic card being inserted into the central slot and a locking projection inwardly extending to lock with the electronic card.

In an insertion process of the electronic card, a side edge of the electronic card downwardly moves between the limiting walls along the guiding portion, at this time, the electronic card sidewardly resists the arm portion; when the electronic card is fully inserted into the central slot, the arm portion rebounds to make the locking projection lock with the electronic card for preventing the electronic card from moving upwardly.

However, because the arm portion is flexible, the electronic card can be pushed to move along a length direction when an electrical device which is mounted with the card edge connector and the electronic card is vibrated, an electrical connection between the card edge connector and the electronic card would be affected to be unstable; besides, the fitting section is only formed with the step portion to prevent the mounting portion of the retainer from moving upwardly, while there is not any other structure to prevent the retainer from moving downwardly, therefore, the retainer can be pushed downwardly out of the housing when the electronic card downwardly presses the guiding portion in the insertion process of the electronic card.

Hence, an improved card edge connector is desired to overcome the above problems.

BRIEF SUMMARY OF THE INVENTION

According to one aspect of the present invention, a card edge connector for mating with an electronic card, comprises: an elongated housing having a pair of opposed side walls, a central slot between the side walls for receiving a lower edge of the electronic card and a fitting section upwardly extending at one end thereof, the fitting section defining a first U-shaped cavity downwardly extending along an insertion direction of the electronic card from a top end thereof and a mounting slot upwardly extending from a lower end thereof and located at outside of the first cavity along a length direction of the housing, the first cavity communicating with the central slot along a length direction of the housing to receive a side edge of the electronic card, and the mounting slot communicating with the first cavity along the length direction; a plurality of contacts retained to the housing; and a retainer retained in the mounting slot and having a locking projection sidewardly protruding into the first cavity to lock with the electronic card; wherein the mounting slot does not upwardly extend through the fitting section to make the retainer hidden in the fitting section.

According to another aspect of the present invention, a card edge connector for mating with an electronic card, comprises: an elongated housing having a pair of opposed side walls, a central slot extending along a length direction between the side walls, a fitting section and a tower section upwardly extending from opposite two ends thereof, each fitting section and tower section defining a U-shaped cavity downwardly recessed from a top end thereof to receive two side edges of the electronic card and prevent the electronic card from moving along a length direction of the housing; a plurality of contacts retained to the housing; a retainer hid in the fitting section and not upwardly exposing to exterior and having a locking projection inwardly extending into the cavity to lock with one side of the electronic card; and an ejector retained to the tower section and having a locking block inwardly extending and located at an upper outer side of the cavity to lock with another side of the electronic card.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
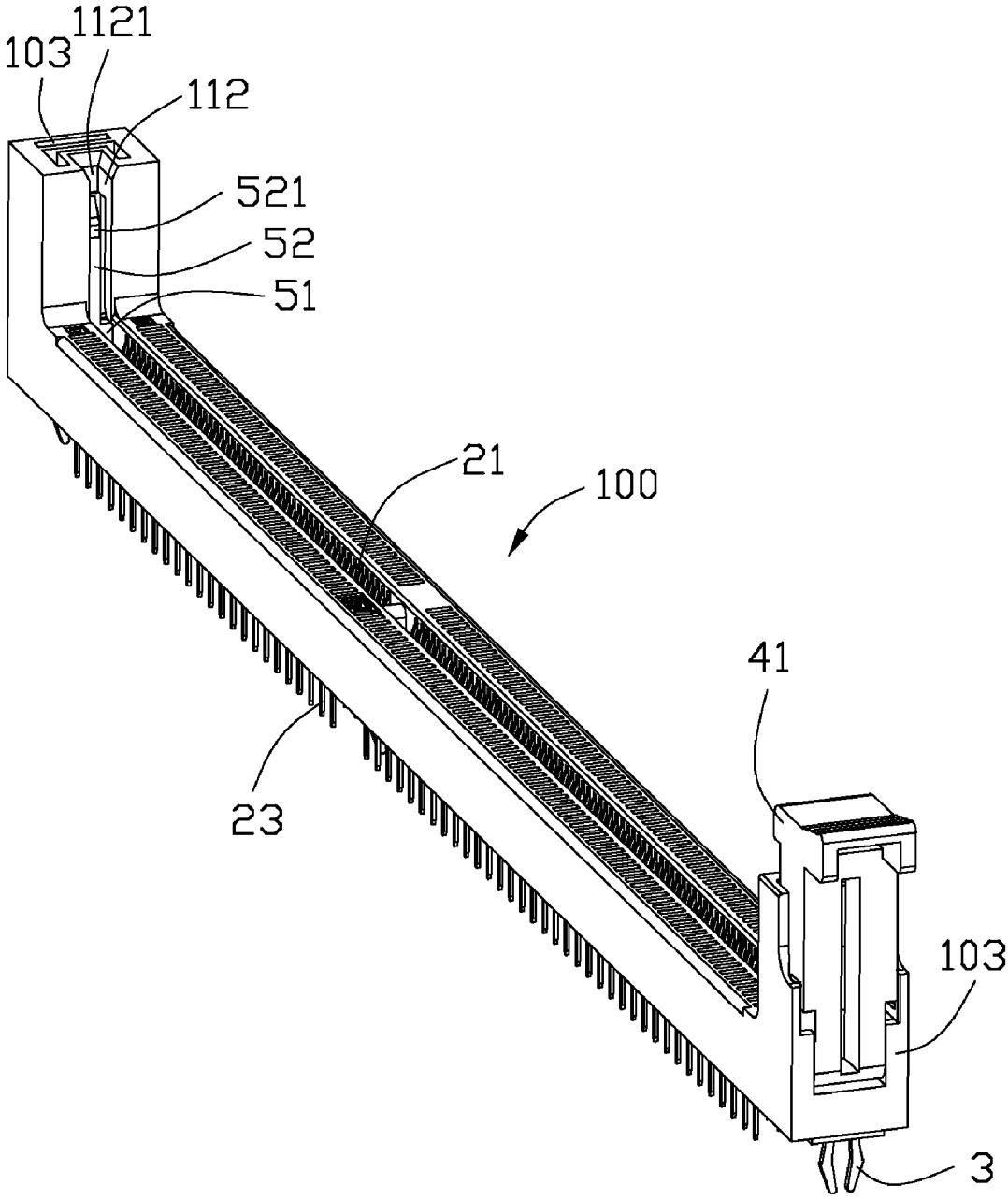
FIG. 1 is a perspective view of a card edge connector according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-8, a card edge connector 100 for mating with an electronic card 200 according to a first embodiment of the present invention is disclosed. The card edge connector 100 comprises an elongated housing 1, a plurality of contacts 2 retained in the housing 1, and a retainer 5 and an ejector 4 attached to opposite two ends of the housing 1 to lock with the electronic card 200, and a pair of board locks 3 retained at a lower side of the housing 1 to fasten with a mother board (not shown). The electronic card 200 has a lower edge 201 with a plurality of metal fingers (not shown) to electrically connect with the contacts 2, and a pair of side edges 2011 at two side thereof. Each side edge 2011 defines at least a notch 2010 to lock with the card edge connector 100.

Referring to FIGS. 1-8, the housing 1 has an elongated body portion 10 extending along a length direction thereof, a fitting section 11 and a tower section 12 respectively extending upwardly from opposite two ends of the body portion 10. The body portion 10 has a bottom wall 105, a top wall 106, a pair of side walls 103 connecting the bottom wall 105 and the top wall 106 and extending along the length direction, and a central slot 101 between the side walls 103 to receive the lower edge 201 of the electronic card 200. Each side wall 103 defines a plurality of passageways 102 extending through the bottom wall 105 and the top wall 106. The passageways 102 communicate with the central slot 101. The housing 1 is formed with a partition board 1010 in the central slot 101 to divide the central slot 101 to two parts with different length for preventing the electronic card 200 from mis-mating.

The fitting section 11 defines a first U-shaped cavity 112 extending along an insertion direction of the electronic card 200 and communicating with the central slot 101 along the length direction of the housing 1 to receive a left side edge 2011 of the electronic card 200. The first cavity 112 is formed between a pair of inner side walls 111 and a connecting wall 1121 connecting upper sides of the inner side walls 111 together for limiting the electronic card 200 from moving along the length direction and a front to back direction perpendicular to the insertion direction and the length direction. Each inner side walls 111 and connecting wall 1121 is formed with an inclined surface at a top end thereof for guiding the side edge 2011 of the electronic card 200 to be inserted into the first cavity 112. The fitting section 11 defines a mounting slot 113 below the connecting wall 1121. The mounting slot 113 is recessed upwardly from the bottom wall 105 and communicates with the first cavity 112 and the central slot 101 along the length direction. The mounting slot 113 has a fastening slot 1131 at a lower side thereof and a receiving slot 1132 at an upper side thereof. The fastening slot 1131 is wider than the receiving slot 1132 along the front to back direction, therefore, the fastening slot 1131 and the receiving slot 1132 form a first step portion 1134 at an intersection portion therebetween. The first step portion 1134 downwardly faces to exterior.

The fitting section 11 has a first groove 116 recessed downwardly from a top end thereof and a limiting wall 1122 at an outer side of the first groove 116. The first groove 116 is located at an outer side of the connecting wall 1121 and communicates with the mounting slot 113 along the length direction. The first groove 116 does not downwardly extend through the bottom wall 105, and has a lower slot 1161 at a lower side thereof and an upper slot 1162 at an upper side thereof. The lower slot 1161 communicates with an upper side of the fastening slot 1131 along the length direction. The upper slot 1162 communicates with the receiving slot 1132 along the length direction. The upper slot 1162 is wider than the lower slot 1161 along the length direction for supplying a large deformed space to the retainer 5. The lower slot 1161 and a lower side of the fastening slot 1131 form a second step portion 1133 at an intersection position therebetween. The second step portion 1133 upwardly faces to exterior.

The fitting section 11 further defines a first retaining slit 1051 recessed upwardly from the bottom wall 105 to retain the board lock 3 and a second groove 117 recessed downwardly from a top end thereof. The retaining slit 1051 is located at an outer side of the mounting slot 113 along the length direction. The second groove 117 is located at an outer side of the limiting wall 1122 along the length direction.

The tower section 12 defines a second U-shaped cavity 122 extending along an insertion direction of the electronic card 200 and communicating with the central slot 101 along the length direction to receive a right side edge 2011 of the electronic card 200. The second cavity 122 is formed between a pair of inner side walls 121 and a connecting wall 1221 connecting upper sides of the inner side walls 121 together for limiting the electronic card 200 from moving along the length direction and the front to back direction perpendicular to the insertion direction and the length direction. The tower section 12 further defines a receiving space 123 at an outer side of the central slot 101 to retain the ejector 4. Each inner side wall of the receiving space 123 defines an axle hole 124 and a cutout 125 communicating with the receiving space 123 along the front to back direction. The axle hole 124 is located below the cutout 125. The bottom wall 105 defines a second retaining slits 1052 at a lower side of the tower section 12 and a third retaining slit 1053 at a lower side of the partition board 1010 to retain the board locks 3.

Figure 2:
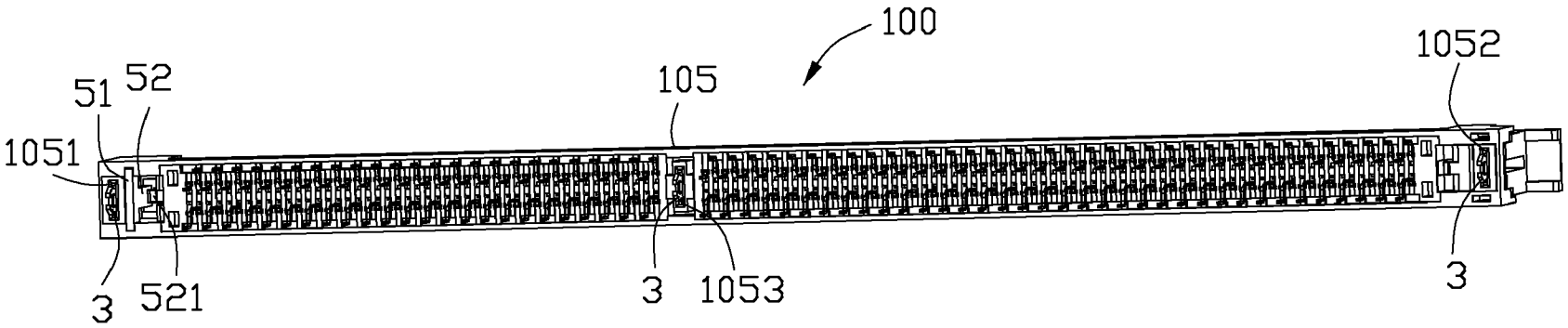
FIG. 2 is a view similar to FIG. 1, while taken from a different aspect.
Figure 3:
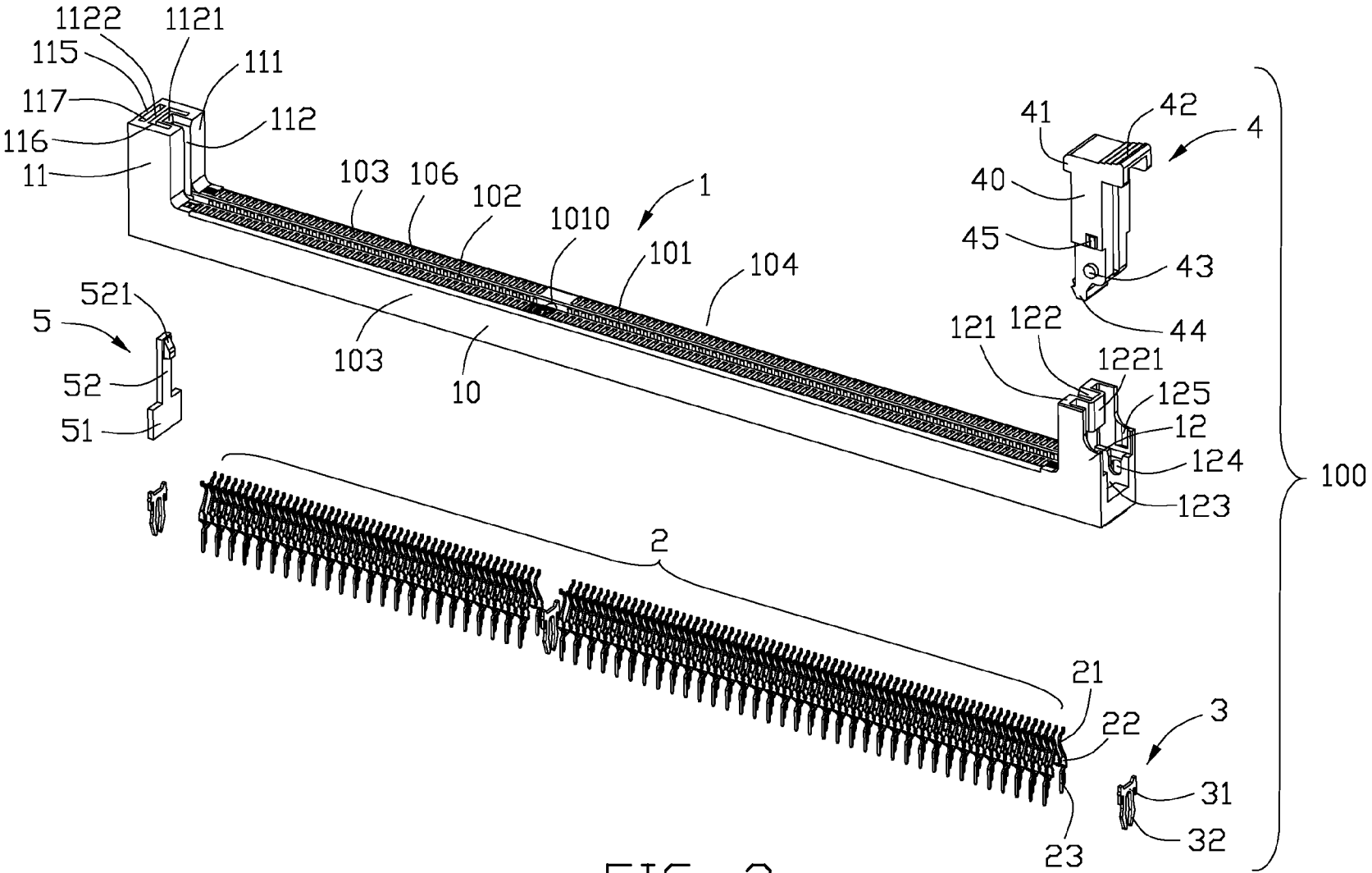
FIG. 3 is an exploded view of the card edge connector shown in FIG. 1.
Figure 4:
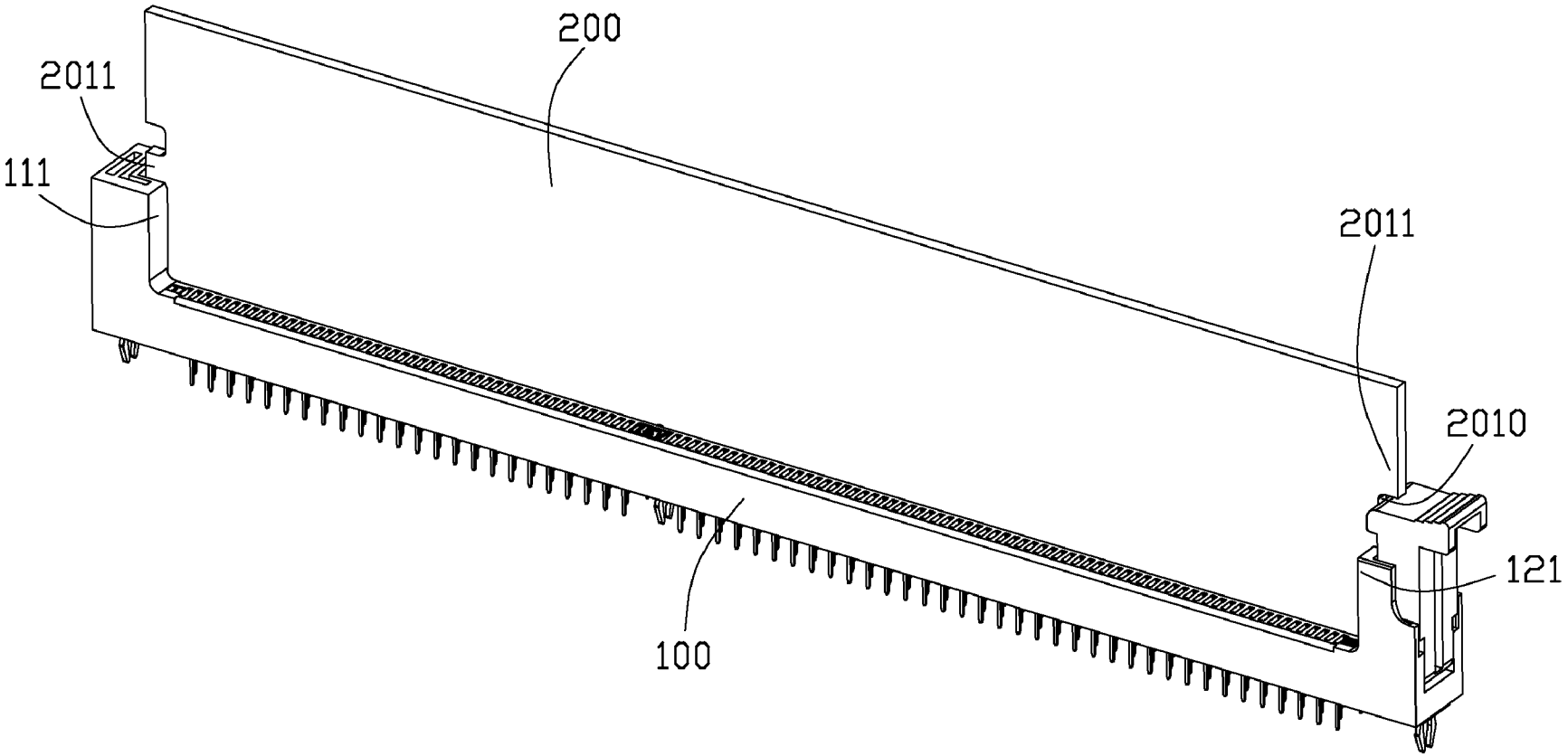
FIG. 4 is a perspective view of the card edge connector with an electronic card being inserted therein.
Figure 5:
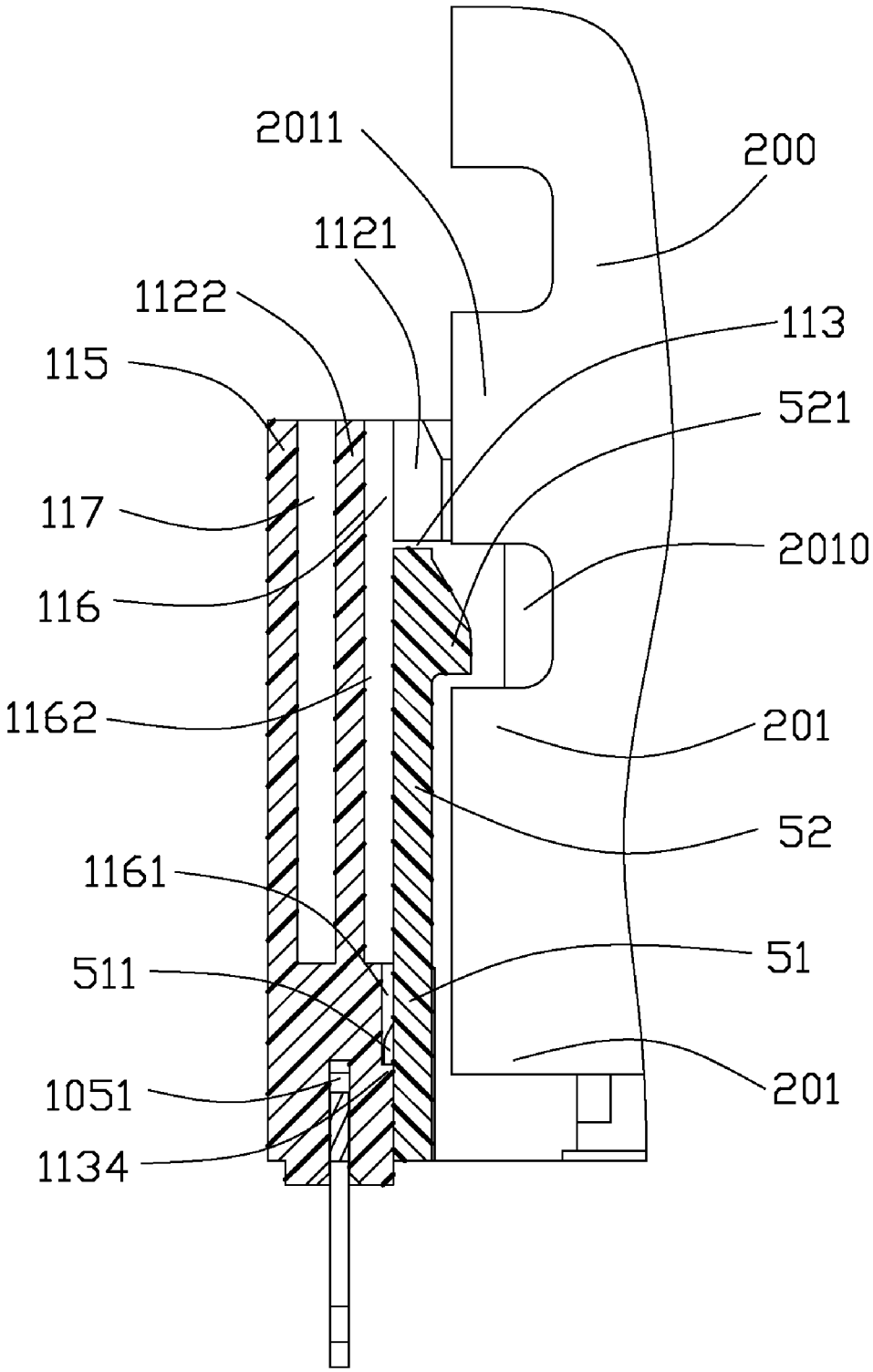
FIG. 5 is a partly cross-section view of the card edge connector and the electronic card.
Figure 6:
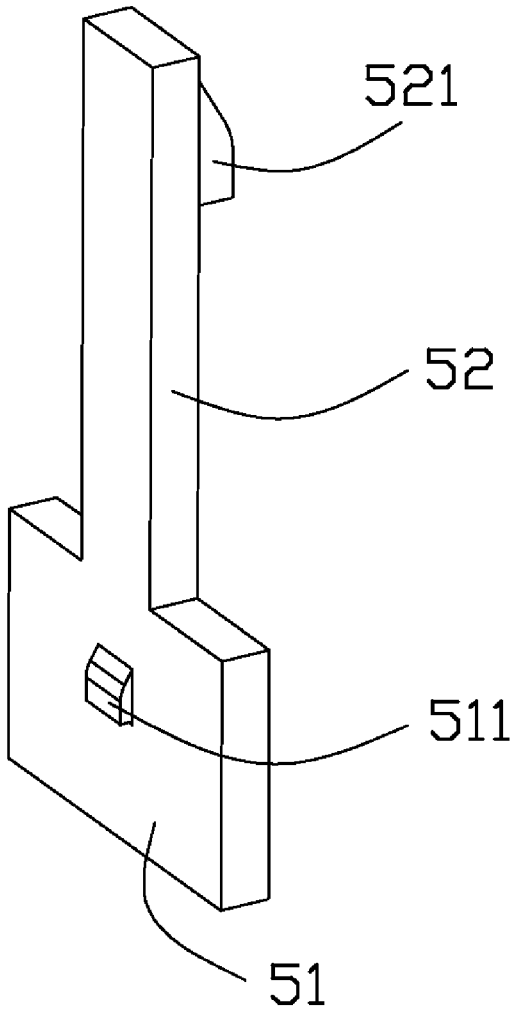
FIG. 6 is a perspective view of a retainer of the card edge connector shown in FIG. 3.
Figure 7:
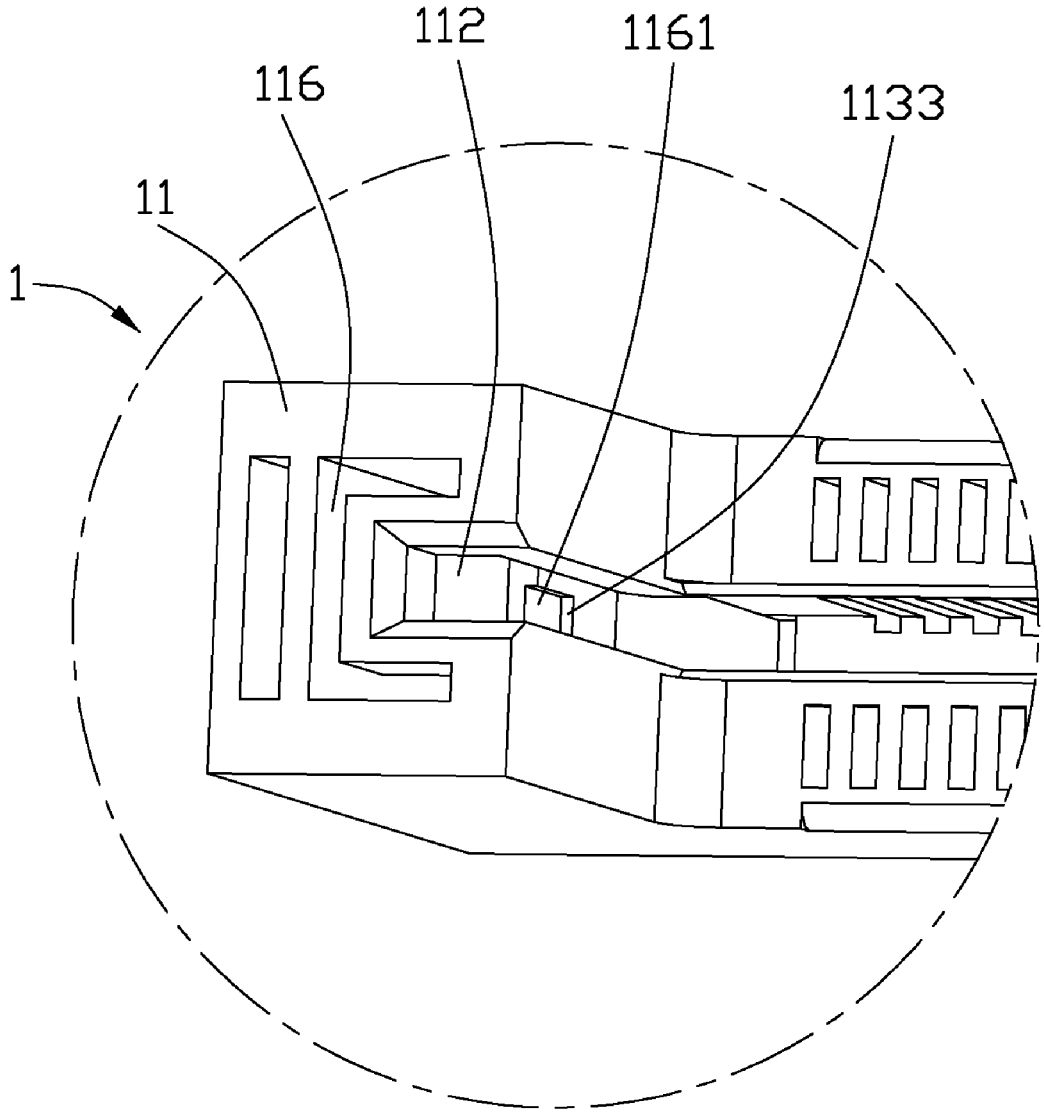
FIG. 7 is a partly perspective view of a housing of the card edge connector shown in FIG. 3.
Figure 8:
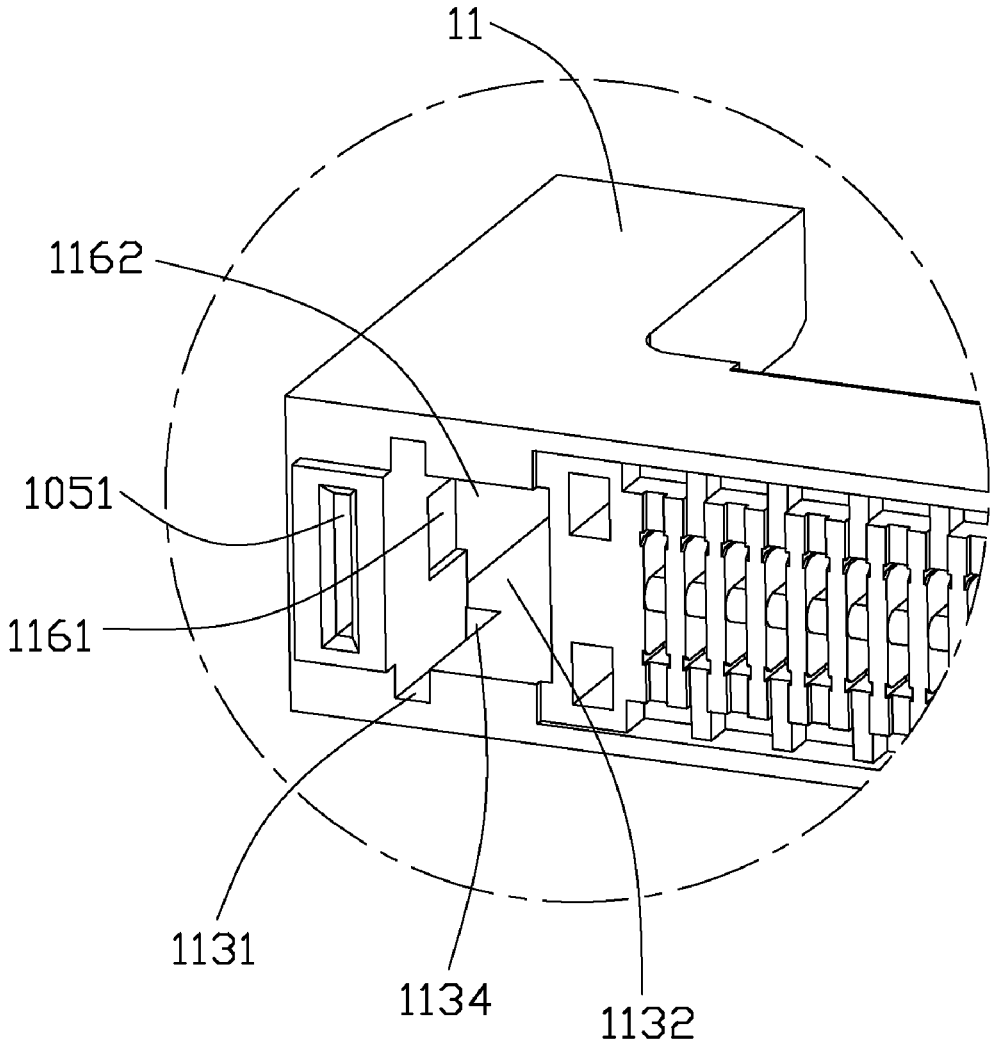
FIG. 8 is a view similar to FIG. 7, while taken from a different aspect.

Referring to FIGS. 1-3, the contacts 2 are arranged in two rows respectively received in the passageways 101 of the two side walls 103. Each contact 2 has a securing portion 22 retained in the passageways 101, a contact portion 21 upwardly extending from a top end of the securing portion 22, and a tail portion 23 downwardly extending out of bottom wall 105 from a lower end of the securing portion 22. The contact portions 21 protrude into the central slot 101 to electrically connect with the metal fingers of the electronic card 200. The tail portions 23 are arranged in four rows to connect with the mother board.

Referring to FIGS. 2 and 3, each board lock 3 has a retaining portion 31 retained in the retaining slits 1051, 1052, 1053 and a pair of soldering legs 32 downwardly extending from the retaining portion 31 to lock with the mother board.

Referring to FIGS. 1-4, the ejector 4 has a base portion 40 retained in the receiving space 123, a locking block 41 inwardly extending from a top end of the base portion 40, an operating portion 42 outwardly extending from the top end of the base portion 40, and an ejecting portion 44 inwardly extending from a lower end of the base portion 40 to eject the electronic card 200 out of the central slot 101. The base portion 40 is formed with a pair of pivots 43 outwardly extending from two sides thereof to engage with the axle holes 124 and a pair of protrusions 45 protruding outwardly to lock with the cutouts 125. The locking block 41 is located at an upper outer side of the tower section 12 and inwardly extending to an upper outer side of the second cavity 122 to lock with a notch of a right side edge of the electronic card 200. The operating portion 42 extends beyond the tower section 12 for being conveniently operated. The ejecting portion 44 extends to a lower side of the first cavity 112 to resist the lower edge 201 of the electronic card 200.

Referring to FIGS. 2-6, the retainer 5 is flat and made of a kind of insulative material with a well abrasion resistance. The retainer 5 has a flat fastening portion 51 retained in the fastening slot 1131 and a flexible arm portion 52 upwardly extending into the receiving slot 1132. The fastening portion 51 is wider than the arm portion 52 along the front to back direction, and has a wedge-shaped hook 511 outwardly extending from an out middle position thereof. The hook 511 is received in the lower slot 1161 and downwardly resists the second step portion 1133 to prevent the retainer 5 from moving downwardly. Besides, the fastening portion 51 upwardly resists the first step portion 1134 to prevent the retainer 5 from moving upwardly, thereby the fastening portion 51 can be stably retained in the mounting slot 131.

The arm portion 52 is located below the connecting wall 1121 and located at a common plane with the connecting wall 1121. The arm portion 52 has a wedge-shaped locking projection 521 inwardly extending into the first cavity 112 from a top end thereof. Therefore, the whole retainer 5 is fully hidden in the fitting section 11 and does not expose to outside of the fitting section 11, then the retainer 5 can be protected from being collided unexpectedly. The locking projection 521 has an inclined plane at an upper side thereof to guide the electronic card 200 in the insertion process and a level plane at a lower side thereof to prevent the electronic card 200 from moving out of the card edge connector 100 in a working status. The arm portion 52 can be pushed into the first groove 116 by the electronic card 200 in the insertion process and rebounds to make the locking projection 521 lock with the notch of the side edge 2011 when the electronic card 200 is fully inserted into the central slot 101.

The retainer 5 in the present invention is separated from the housing 1, therefore, the retainer 5 can be made of the insultive material which has the desirable abrasion resistance, and the housing 1 can be still made by an ordinary insulative material, which can increase the abrasion resistance of the locking projection 521 and prolong the life of the card edge connector 100. Besides, the housing 1 does not need to be made of the insulative material same as the retainer 5, which would decrease a manufacture cost of the card edge connector 100 with well abrasion resistance.

In the insertion process of the electronic card 200, firstly, rotating the ejector 4 outwardly to release the second cavity 122; then inserting the electronic card 200 downwardly along the inclined surfaces of the inner side walls 111, 1121, 121, 1221, the electronic card 200 would sidewardly resist the locking projection 521, and the arm portion 52 is pushed sidewardly into the first groove 161 to resist the limiting wall 1122; secondly, further inserting the electronic card 200 downwardly, the lower edge 201 of the electronic card 200 downwardly pushes the ejecting portion 44 to make the ejector 4 rotate along an anticlockwise direction; when the electronic card 200 is completely inserted into the central slot 101, the arm portion 52 rebounds to make the locking projection 521 lock with the notch 2010 of the left side edge 2011 of the electronic card 200, the locking block 41 locks with the notch 2010 of the right side edge 2011 of the electronic card 200, and the protrusions 45 of the ejector 4 engage with the cutouts 125 to keep the ejector 4 to a locking status.

In a withdrawing process of the electronic card 200, firstly, pressing the operating portion 42 to make the ejector 4 rotate along a clockwise direction, then the locking block 41 moves out of the notch 2010, and the ejecting portion 44 pushes one side of the lower edge 201 of the electronic card 200 upwardly to make one side of the lower edge 201 out of the central slot 101; then pulling the electronic card 200 upwardly and sidewardly to make the notch 2010 of the left side edge 2011 disengage with the locking projection 521. Then the electronic card 200 can be dropped out of card edge connector 100.

Figure 9:
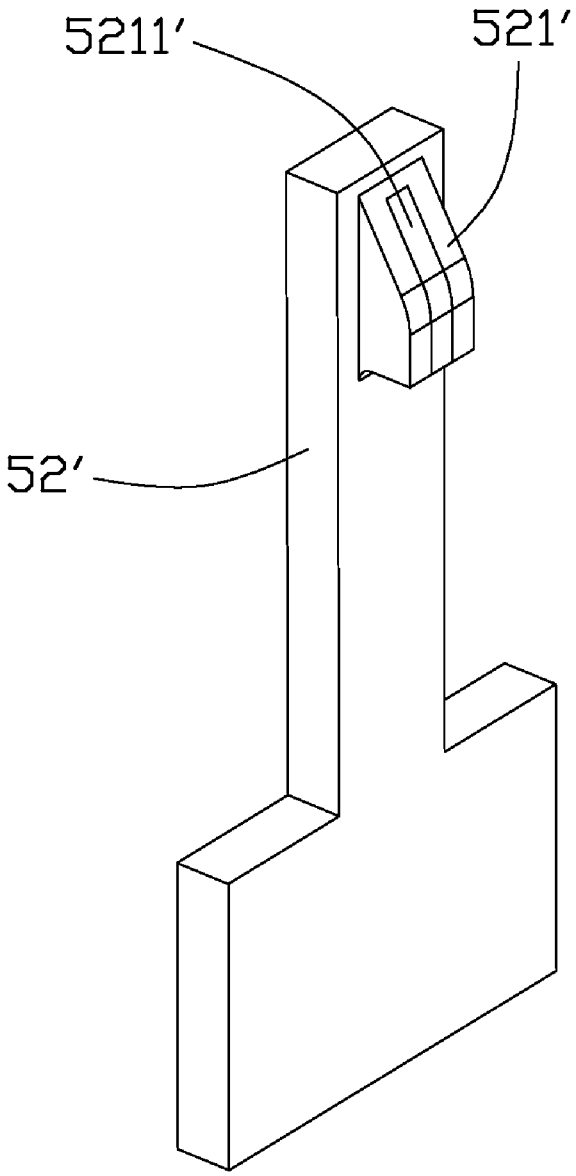
FIG. 9 is an exploded view of the card edge connector according to the second embodiment of the present invention.
Figure 10:
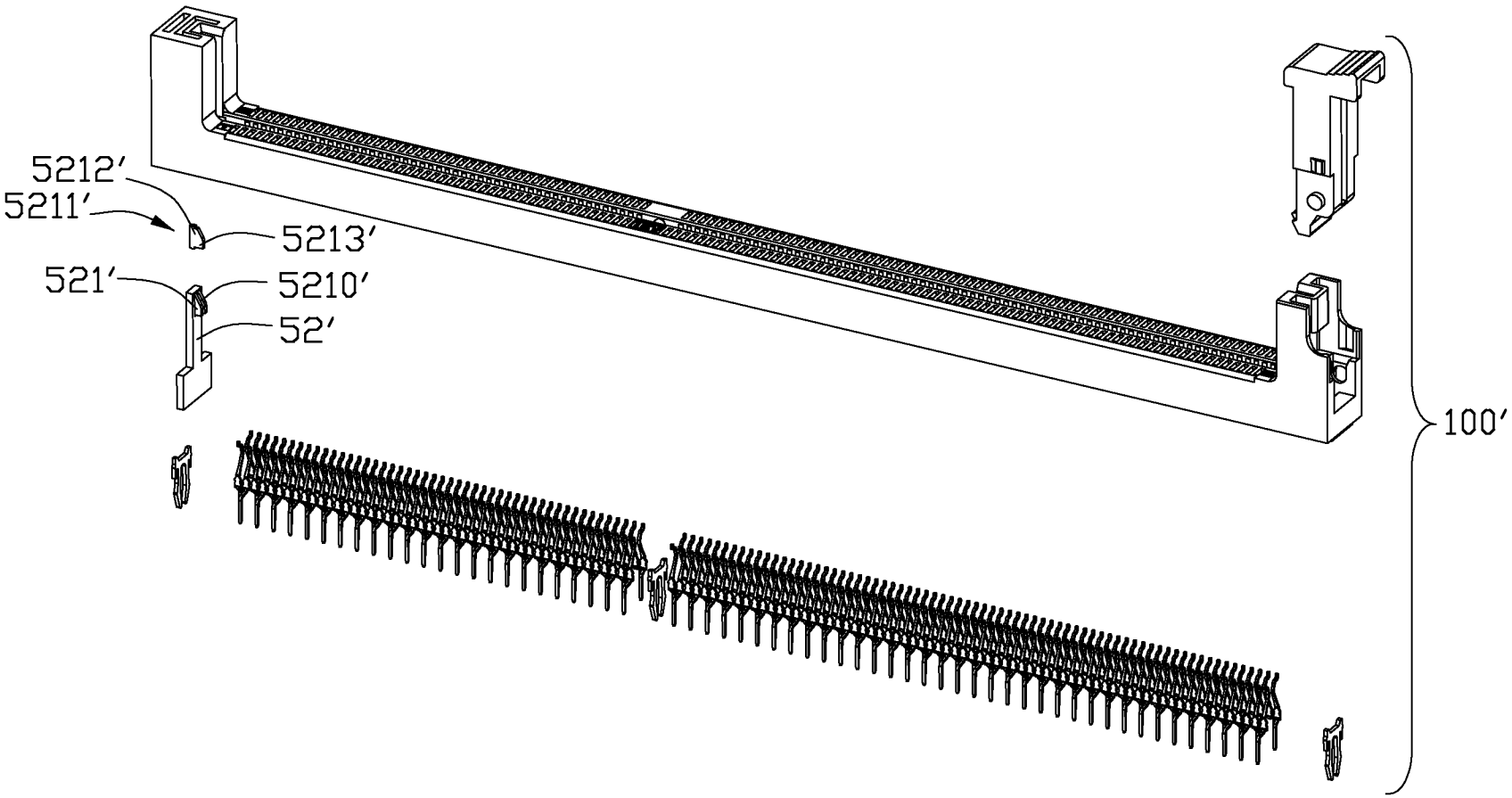
FIG. 10 is a perspective view of a retainer of a card edge connector according to a second embodiment of the present invention.
Figure 11:
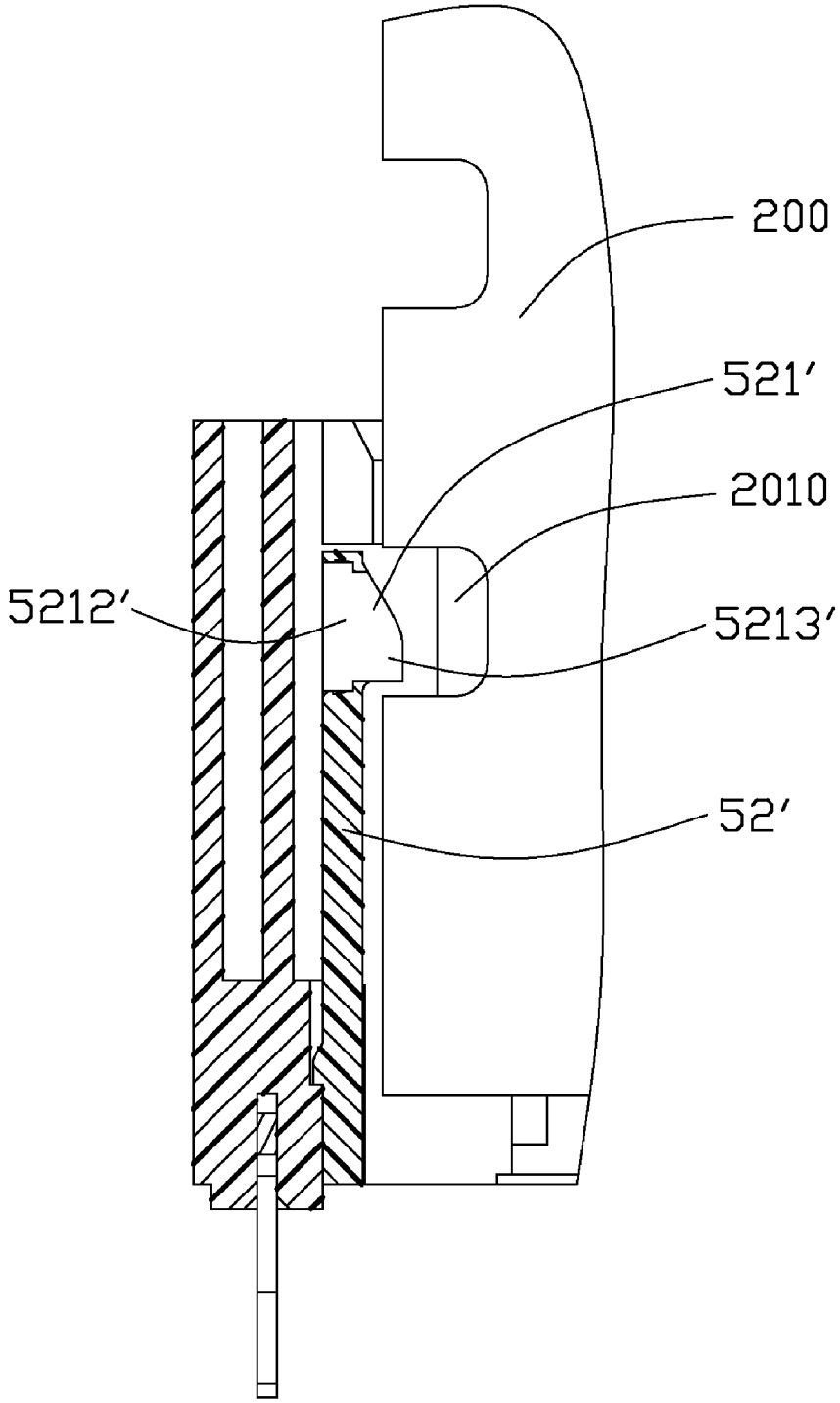
FIG. 11 is a partly cross-section view of the card edge connector and a electronic card.

Referring to FIGS. 9-11, a card edge connector 100' according to a second embodiment is disclosed. The card edge connectors 100, 100' in the first and second embodiments are similar to each other, and have a small difference. The difference is that: the locking projection 521' in the second embodiment further defines a slit 5210' extending along the length direction, and the card edge connector 100' further comprises a metal tab 5211' retained in the slit 5210' to strengthen the locking projection 521' and improve the abrasion resistance of the locking projection 521'. The slit 5210' outwardly extends through arm portion 52' along the length direction. The metal tab 5211' has a rectangular fixing portion 5212' retained in the slit 5210' of the arm portion 52' and a wedge-shaped extension portion 5213' received in the slit 5210' of the locking projection 521'. The extension portion 5213' and the locking projection 521' jointly lock with the notch 2010 of the electronic card 200 to strengthen the locking projection 521' and prolong the life of the card edge connector 100'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for mating with an electronic card, comprising:

an elongated housing having a pair of opposed side walls, a central slot between the side walls for receiving a lower edge of the electronic card and a fitting section upwardly extending at one end thereof, the fitting section defining a first cavity downwardly extending along an insertion direction of the electronic card from a top end thereof and a mounting slot upwardly extending from a bottom end thereof and located at an outside of the first cavity along a length direction of the housing, the first cavity communicating with the central slot along a length direction of the housing to receive a side edge of the electronic card, and the mounting slot communicating with the first cavity along the length direction;

a plurality of contacts retained to the housing; and a retainer received and retained in the mounting slot and having a locking projection protruding into the first cavity to lock with the electronic card;

wherein the mounting slot does not upwardly extend through the fitting section so that the retainer is hidden in the fitting section in a top to bottom direction except the locking projection.

2. The card edge connector as claimed in claim 1, wherein the first cavity is formed between a pair of inner side walls and a connecting wall connecting upper sides of the inner side walls together for limiting the electronic card moving along the length direction and a front to back direction perpendicular to the insertion direction and the length direction.

3. The card edge connector as claimed in claim 2, wherein the mounting slot is formed under the connecting wall, and the retainer does not extend into the first cavity except the locking projection.

4. The card edge connector as claimed in claim 3, wherein the mounting slot has a wide fastening slot at a lower side thereof and a narrow receiving slot at an upper side thereof, and the retainer has a wide fastening portion fastened in the fastening slot and a flexible arm portion received in the receiving slot.

5. The card edge connector as claimed in claim 4, wherein the fitting section further defines a first groove at outside of the connecting wall along the length direction, and the first groove has a lower groove communicating with an upper side of the fastening slot and an upper groove communicating with the receiving slot along the length direction for supplying a deformed space to the arm portion.

6. The card edge connector as claimed in claim 5, wherein the fastening slot and the receiving slot form a first step portion at an intersection position therebetween to prevent the fastening portion from moving upwardly, and the lower groove and a lower side of the fastening slot form a second step portion at an intersection position therebetween, and the fastening portion has a hook outwardly extending to downwardly resist the second step portion for preventing the fastening portion from moving downwardly.

7. The card edge connector as claimed in claim 4, wherein the locking projection extends from a top end of the arm portion and has an inclined plane at an upper and inner side thereof to guide the electronic card being inserted into the first cavity.

8. The card edge connector as claimed in claim 1, wherein the housing has a tower section upwardly extending at another end thereof, and the tower section defines a second U-shaped cavity extending along an insertion direction of the electronic card from a top end thereof to receive another side of the electronic card and prevent the electronic card from moving along the length direction and a front to back direction perpendicular to the insertion direction and the length direction.

9. The card edge connector as claimed in claim 8, further comprising an ejector retained on the tower section, the tower section defines a receiving space at outside of the second cavity along the length direction to retain the ejector, and the ejector has a locking block inwardly extending from a top end thereof and located at an upper outer side of the second cavity to lock with the electronic card.

10. The card edge connector as claimed in claim 1, wherein the retainer is made of a kind of insulative material with a better abrasion resistance than that of the housing.

11. The card edge connector as claimed in claim 1, further comprising a metal tab retained to the locking projection along the insertion direction to strengthen the locking projection.

12. A card edge connector for mating with an electronic card, comprising:

an elongated housing having a pair of opposed side walls, a central slot extending along a length direction between the side walls, a fitting section and a tower section upwardly extending from opposite two ends thereof, each fitting section and tower section defining a cavity downwardly recessed from a top end thereof to receive two side edges of the electronic card and prevent the electronic card from moving along a length direction of the housing;

a plurality of contacts retained to the housing;

a retainer hidden in the fitting section and not upwardly exposing to exterior except a locking projection thereof inwardly extending into the cavity to lock with one side of the electronic card; and an ejector retained to the tower section and having a locking block inwardly extending and located at an upper outer side of the cavity to lock with another side of the electronic card.

13. The card edge connector as claimed in claim 12, wherein the fitting section defines a mounting slot upwardly recessed from a lower end thereof to retain the retainer, the mounting slot does not extend through the fitting section along an insertion direction of the electronic card so as to hide the retainer, and the mounting slot communicates with the cavity and located on an outside of the cavity along the length direction.

14. The card edge connector as claimed in claim 13, wherein the mounting slot has a fastening portion at a lower side thereof and a receiving slot at an upper side thereof, and the retainer has a fastening portion fastened in the fastening portion and a flexible arm portion upwardly extending into the receiving slot.

15. The card edge connector as claimed in claim 14, wherein the fitting section further defines a first groove at an outer side of the cavity along the length direction, and the first groove communicates with the receiving slot along the length direction for supplying a deformed space to the arm portion.

16. The card edge connector as claimed in claim 14, wherein the receiving slot communicates with the cavity along the length direction, and the locking projection inwardly extends from a top end of the arm portion.

17. An electrical connector assembly comprising:

an elongated housing extending along a lengthwise direction;

a center slot extending in the housing along said lengthwise direction;

a plurality of contacts disposed in the housing and located by two sides of the center slot;

a pair of towers located at two opposite ends of the housing;

an ejector rotatably mounted upon one of the towers and defining an upper inner locker and an upper outer operator both of which are located above a top face of said corresponding tower under condition that the upper inner locker extends toward the center slot while the upper outer operator extends away from the center slot, and a lower kicker extending into the center slot; and a resilient retainer fixed to the other of said towers and defining a locking protrusion extending into the center slot;

a top portion of the retainer is located under a top face of the corresponding tower so as to avoid inadvertent impact from an exterior; wherein the upper inner locker of the ejector and the locking protrusion are located at different levels for respectively locking into corresponding notches respectively located in two sides of the daughter card.

18. The electrical connector assembly as claimed in claim 17, wherein each of said towers defines a U-shaped structure to sandwich the corresponding side of the daughter card.

19. The electrical connector assembly as claimed in claim 18, wherein the U-shaped structure is located above the retainer in the corresponding tower.

20. The electrical connector assembly as claimed in claim 17, wherein the retainer and the corresponding tower are configured to only allow the retainer to be assembled upwardly into the corresponding tower from a bottom face of the housing.

* * * * *